US010267601B1

(12) United States Patent
Beck

(10) Patent No.: US 10,267,601 B1
(45) Date of Patent: Apr. 23, 2019

(54) BALLISTIC DOLLY SYSTEM

(71) Applicant: Tyr Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 0 days.

(21) Appl. No.: 15/896,840

(22) Filed: Feb. 14, 2018

(51) Int. Cl.
*F41H 5/14* (2006.01)

(52) U.S. Cl.
CPC ..... *F41H 5/14* (2013.01)

(58) Field of Classification Search
CPC .... B62B 1/14; B62B 1/12; B62B 1/26; F41H 5/14; F41H 5/08; F41H 5/06; F41H 5/013
See application file for complete search history.

(56) References Cited

U.S. PATENT DOCUMENTS 660,478 A * 10/1900 Wells ..... F41H 5/08 109/49.5
1,253,964 A * 1/1918 Hack ..... F41H 5/14 109/9
1,257,484 A * 2/1918 Heide ..... F41H 5/14 89/36.09
1,261,518 A * 4/1918 Hahre ..... F41H 5/14 109/49.5
1,267,588 A * 5/1918 Poniatowski ..... F41H 5/14 89/36.09
1,274,721 A * 8/1918 Krzan ..... F41H 5/24 89/36.15
1,281,400 A * 10/1918 Larnell ..... F41H 5/14 109/49.5
1,304,541 A * 5/1919 Clark ..... F41H 5/14 109/22
1,308,286 A * 7/1919 Korn ..... F41H 5/14 89/36.09
2,209,654 A * 7/1940 Loeser, Jr. ..... F41H 5/08 109/49.5
2,921,317 A * 1/1960 Tifft ..... F41H 5/08 2/2.5
4,245,546 A * 1/1981 Chaires ..... F41H 5/14 109/49.5

(Continued)

FOREIGN PATENT DOCUMENTS

CN 201555512 U * 8/2010
CN 201697556 U * 1/2011

(Continued)

*Primary Examiner* — Jacob B Meyer
(74) *Attorney, Agent, or Firm* — Mark Williams

(57) ABSTRACT

Implementations described and claimed herein provide a ballistic dolly system. In one implementation, a frame assembly of a ballistic dolly has an elongated member. A seat assembly is mounted to the elongated member. The seat assembly has one or more surfaces adapted to engage an inner surface of a body of an overlap panel. One or more seat channels are formed in the seat assembly. Each of the one or more seat channels is adapted to releasably engage an edge of a body of an armor panel. Each of the one or more seat channels orients the edge of the body of the armor panel in an overlapping relationship with the body of the overlap panel such that a portion of the body of the armor panel overlaps with a portion of the body of the overlap panel. The overlapping relationship covers a ballistic void of the ballistic dolly.

21 Claims, 20 Drawing Sheets

(56) References Cited

U.S. PATENT DOCUMENTS 4,781,101 A * 11/1988 Zevuluni ..... F41H 5/14 109/49.5
6,622,607 B1 * 9/2003 Miller ..... F41H 5/06 2/2.5
6,711,980 B2 * 3/2004 Kropf ..... F41H 5/14 89/36.07
6,845,701 B2 * 1/2005 Drackett ..... F41H 5/14 89/36.09
6,907,811 B2 * 6/2005 White ..... F41H 5/06 109/49.5
7,520,207 B1 * 4/2009 Fuqua ..... F41H 5/013 109/82
7,819,049 B2 * 10/2010 Pastrnak ..... F42D 5/045 86/50
7,849,781 B2 * 12/2010 White ..... F41H 5/14 89/36.07
7,891,283 B2 * 2/2011 Kleniatis ..... F41H 5/14 89/36.09
7,905,168 B2 * 3/2011 Pastrnak ..... F42D 5/045 86/50
8,001,880 B2 * 8/2011 White ..... E01F 13/12 404/6
8,015,910 B1 * 9/2011 Fuqua ..... F41H 5/14 89/36.01
8,276,499 B1 * 10/2012 Fuqua ..... F41H 5/14 89/36.09
8,371,207 B2 * 2/2013 White ..... E01F 13/12 404/6
8,418,595 B1 * 4/2013 Saucedo ..... F41H 5/26 89/36.01
8,549,979 B2 * 10/2013 Spransy ..... F41H 5/013 89/36.07
8,590,439 B2 * 11/2013 White ..... E01F 13/12 404/6
8,726,782 B2 * 5/2014 White ..... F41H 5/14 89/36.09
9,103,634 B2 * 8/2015 Lee ..... F41H 5/06
9,200,875 B1 * 12/2015 Saucedo ..... F41H 5/26
9,347,747 B2 * 5/2016 Mickiewicz ..... F41H 5/26
9,347,748 B1 * 5/2016 Crisp ..... F41H 5/08
9,360,281 B1 * 6/2016 De Gaglia ..... F41H 5/24
9,448,041 B2 * 9/2016 Gonda ..... F41H 5/14
2003/0167911 A1 * 9/2003 White ..... F41H 5/06 89/36.07
2004/0255769 A1 * 12/2004 Drackett ..... F41H 5/14 89/36.09
2008/0022848 A1 * 1/2008 Pastrnak ..... F41H 5/08 89/36.09
2008/0121100 A1 * 5/2008 Pastrnak ..... F41H 5/08 89/36.09
2009/0067923 A1 * 3/2009 Whitford ..... F41H 5/14 404/6
2011/0011255 A1 * 1/2011 Kleniatis ..... F41H 5/08 89/36.09
2012/0174768 A1 * 7/2012 Spransy ..... F41H 5/013 89/36.09
2014/0151154 A1 * 6/2014 Sama, II ..... A01M 31/025 182/223
2014/0238225 A1 * 8/2014 Mickiewicz ..... F41H 5/08 89/36.07
2016/0216080 A1 * 7/2016 Gonda ..... F41H 5/14

FOREIGN PATENT DOCUMENTS

CN 206556515 U * 10/2017
KR 2017068335 a * 6/2017
WO WO-2016003379 A1 * 1/2016 ..... F41H 5/08

* cited by examiner

BALLISTIC DOLLY SYSTEM

TECHNICAL FIELD

Aspects of the present disclosure relate to systems and methods for protecting the an individual from threats while providing load carriage in a tactical environment. More particularly, the present disclosure relates to a ballistic dolly system having a ballistic dolly adapted to receive one or more armor panels in a customized arrangement without a gap in ballistic coverage.

BACKGROUND

In a tactical environment, tactical personnel, such as military, law enforcement, or other combat or peacekeeping personnel, may be the target of ballistic projectiles or other threats to the body. Ballistic shields are generally employed in such environments to stop or deflect such threats to protect the individual. However, conventional ballistic shields are often cumbersome and difficult to maneuver during use. Further, conventional ballistic shields typically include a ballistic void, forming a gap in ballistic coverage and leaving the individual vulnerable to threats. Exacerbating these problems, ballistic shields conventionally are fixed, such that the individual cannot adapt to the specific circumstances faced in a particular tactical environment, and provide ballistic protection at the expense of load carriage, forcing the individual to maneuver the ballistic shield while carrying mission critical equipment. It is with these observations in mind, among others, that various aspects of the present disclosure were conceived and developed.

SUMMARY

Implementations described and claimed herein address the foregoing problems, among others, by providing a ballistic dolly system. In one implementation, a frame assembly of a ballistic dolly has an elongated member. A seat assembly is mounted to the elongated member. The seat assembly has one or more surfaces adapted to engage an inner surface of a body of an overlap panel. One or more seat channels are formed in the seat assembly. Each of the one or more seat channels is adapted to releasably engage an edge of a body of an armor panel. Each of the one or more seat channels orients the edge of the body of the armor panel in an overlapping relationship with the body of the overlap panel such that a portion of the body of the armor panel overlaps with a portion of the body of the overlap panel. The overlapping relationship covers a ballistic void of the ballistic dolly.

In another implementation, an armor panel has a body formed from a ballistic material extending between a first edge and a second edge. The body has an inner surface and an outer surface. The first edge and the second edge are selectably receivable into a seat channel formed in a seat assembly of a ballistic dolly. The seat channel orients the body of the armor panel in an overlapping relationship with the body of the overlap panel such that a portion of the body of the armor panel overlaps with a portion of the body of the overlap panel. The overlapping relationship covering a ballistic void of the ballistic dolly. A bar is mounted to the inner surface of the body of the armor panel. The bar is adapted to releasably engage an attachment assembly disposed along a frame assembly of the ballistic dolly.

In yet another implementation, a frame assembly of a ballistic dolly has an elongated member. A seat assembly is mounted to the elongated member. The seat assembly has one or more surfaces adapted to engage an inner surface of a body of an overlap panel. One or more seat channels are formed in the seat assembly. Each of the one or more seat channels is adapted to releasably engage an edge of a body of an armor panel. Each of the one or more seat channels orients the edge of the body of the armor panel in an overlapping relationship with the body of the overlap panel. A transport assembly is mounted to the frame assembly. The transport assembly is adapted to move the ballistic dolly with a plurality of degrees of freedom.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTIONS OF THE DRAWINGS

DETAILED DESCRIPTION

Aspects of the present disclosure involve a ballistic dolly system having a shield providing protection to an individual from threats, such as ballistic projectiles, shrapnel from explosions, and other threats to the body of the individual. In one aspect, the ballistic dolly system includes a ballistic dolly having a frame configured to releasably engage one or more panels to form a shield. The one or more panels may include an overlap panel mounted to a seat assembly, and one or more armor panels releasably received in a respective seat channel of the channel assembly in a customizable orientation. The seat channels further orient the one or more armor panels in an overlapping relationship with the overlap panel to provide coverage of a ballistic void, which is typically formed as a gap between edges of armor panels through which a threat may penetrate and strike the individual. The ballistic dolly includes a transport assembly adapted to move the ballistic dolly system with a plurality of degrees of freedom, for example, through translation, rotation, and/or the like. A base accessory may be releasably engaged to the ballistic dolly for further dynamic customization. Additionally, one or more accessory panels may be releasably engaged to the ballistic dolly system for load carriage. As such, the ballistic dolly system provides customizable ballistic protection from various threats that may be dynamically adjusted as needed in a tactical environment, while providing load carriage for storing and transporting a load of mission critical equipment.

Figure 1:
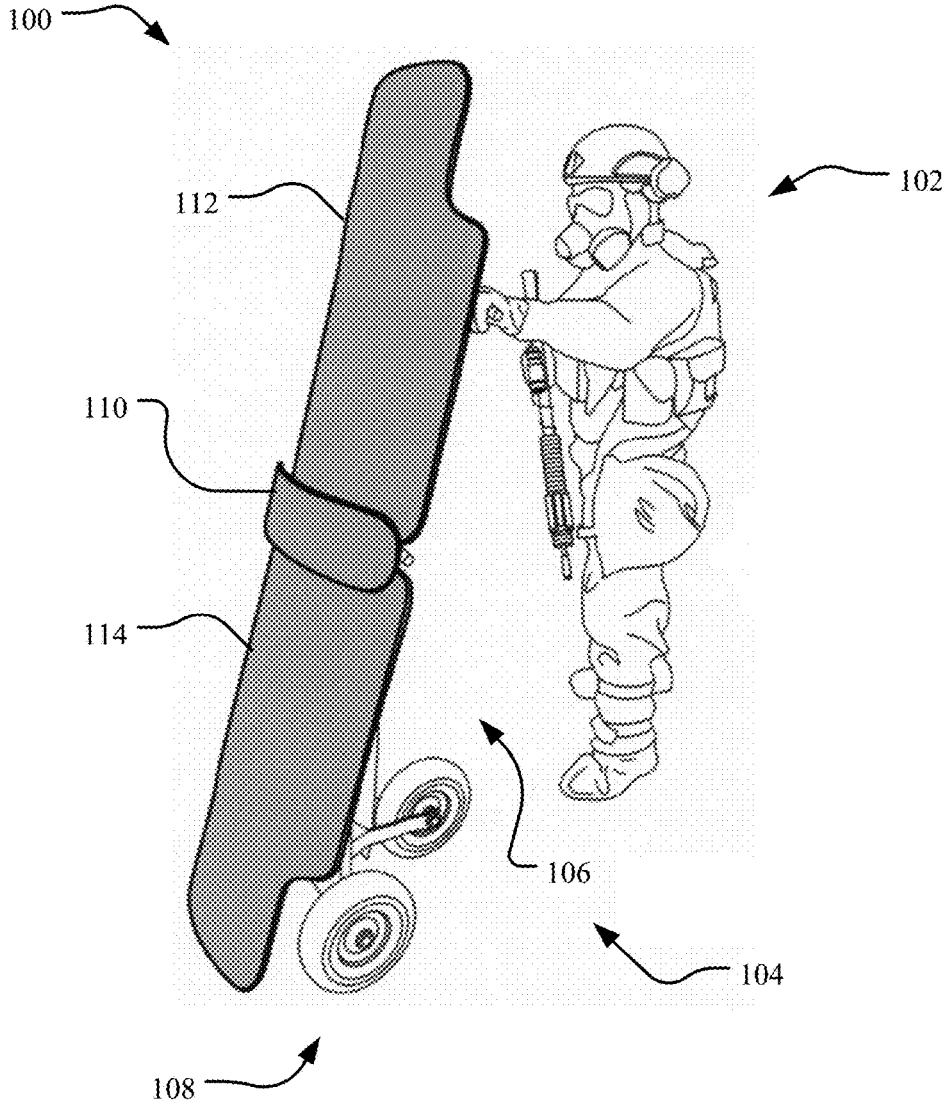
FIG. 1 is a side perspective view of an individual using an example ballistic dolly system in an extended configuration.

To begin a detailed description of an example ballistic dolly system 100 providing protection to an individual 102 from various threats, reference is made to FIG. 1. In one implementation, the ballistic dolly system 100 includes a ballistic dolly 104 having a frame 106 and a transport assembly 108. The frame 106 is adapted to receive one or more panels to form a shield. The one or more panels may include, without limitation, an overlap panel 110 mounted to the frame 106 and one or more armor panels (e.g., a first armor panel 112 and a second armor panel 114).

The ballistic dolly 104 carries and orients one or more armor panels (e.g., 112 and/or 114) into a dynamically customizable shield. The armor panels 112 and 114 are removable and may be inserted in various orientations that are customizable based on the particular tactical environment and needs of the individual 102. For example, the first armor panel 112 may be removed and the frame 106 placed in a collapsed orientation as described herein to provide a half barrier shield, as opposed to the full barrier shield formed by the panels 112 and 114 with the frame 106 disposed in an extended configuration. Further, the first armor panel 112 and/or the second armor panel 114 may be positioned in an inverted orientation or other orientation based on the needs of the individual 102 in operating within the particular tactical environment.

The ballistic dolly 104 is adapted to releasably engage one or more armor panels independent of panel design. More particularly, the panel design, including manufacturer, type, style, shape, size, surface features, and/or other design features, may vary, with the ballistic dolly 104 adapted to releasably engage the armor panels in a customized configuration according to the panel design. For example, a height of the ballistic dolly 104 may be adjusted based on the panel design and/or to form a customized ballistic shield. Additionally, the frame 106 is configured to releasably engage the armor panels in a manner permitting a wide variance in panel design, as described herein.

Variance in panel design is further accommodated by providing the overlap panel 110 to cover a ballistic void. Depending on the panel design of the armor panels 112 and 114, one or more gaps may form between the edges of the armor panels 112 and 114 creating a ballistic void through which a threat may penetrate and strike the individual 102. The overlap panel 110 covers and provides ballistic protection for the ballistic void. In one implementation, the first armor panel 112 and/or the second armor panel 114 are releasably engaged to the frame 106 in an overlapping relationship with the overlap panel 110, with the overlapping relationship covering the ballistic void. The overlapping relationship includes at least a portion of the first armor panel 112 and/or the second armor panel 114 overlapping with at least a portion of the overlap panel 110.

In addition to the dynamic customization of the ballistic shield based on the particular tactical environment, the ballistic dolly system 100 may be easily moved, positioned, and/or otherwise maneuvered. The individual 102 may maneuver the ballistic dolly system 100 using one or more handles disposed along the frame 106. The transport system 108 is adapted to move the ballistic dolly system 100 with a plurality of degrees of freedom, including, but not limited to, translation, rotation, and/or the like. A base accessory may be releasably engaged to the ballistic dolly 104 to further facilitate such movement, as described herein. Further, the ballistic dolly system 100 may be oriented upright, tilted at an angle as shown in FIG. 1, or in other orientations customized based on the particular tactical environment. Again, a base accessory may be used as additional support and/or to further facilitate positioning of the ballistic dolly system 100.

In one implementation, the ballistic dolly system 100 provides load carriage customizable to the particular tactical environment. For example, one or more accessory panels may be releasably engaged to the ballistic dolly system 100 for storing and transporting mission critical equipment, including, without limitation, ammunition, weapons, communication devices, power sources, pouches, medical supplies, nourishment, and/or the like. Additionally, one or more of the panels 110-114 or other portions of the ballistic dolly system 100 may be used to support and/or position one or more weapons in a dynamically customizable manner as described herein.

Figure 2:
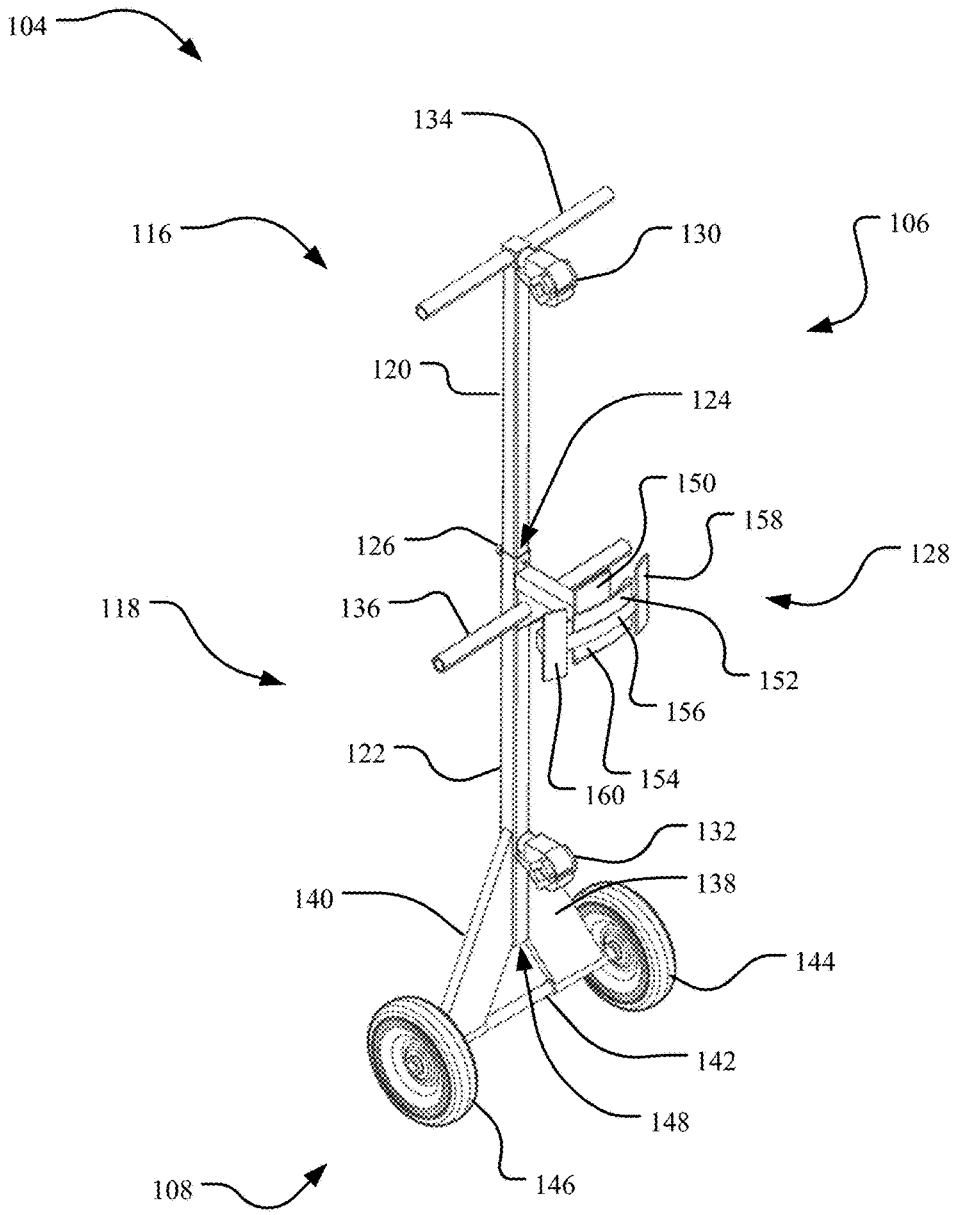
FIGS. 2 and 3 show a front perspective view and a back perspective view, respectively, of an example ballistic dolly in the extended configuration.
Figure 3:
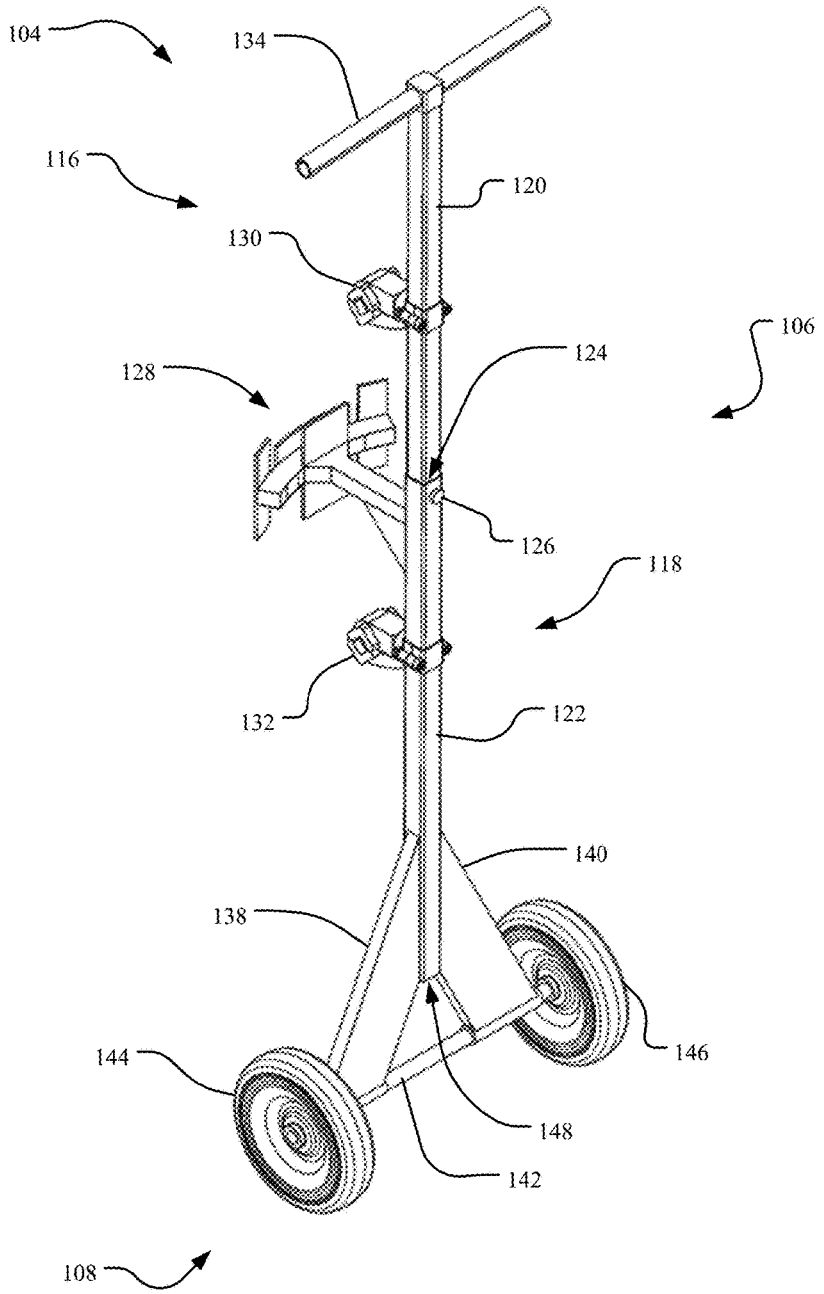
Figure 4:
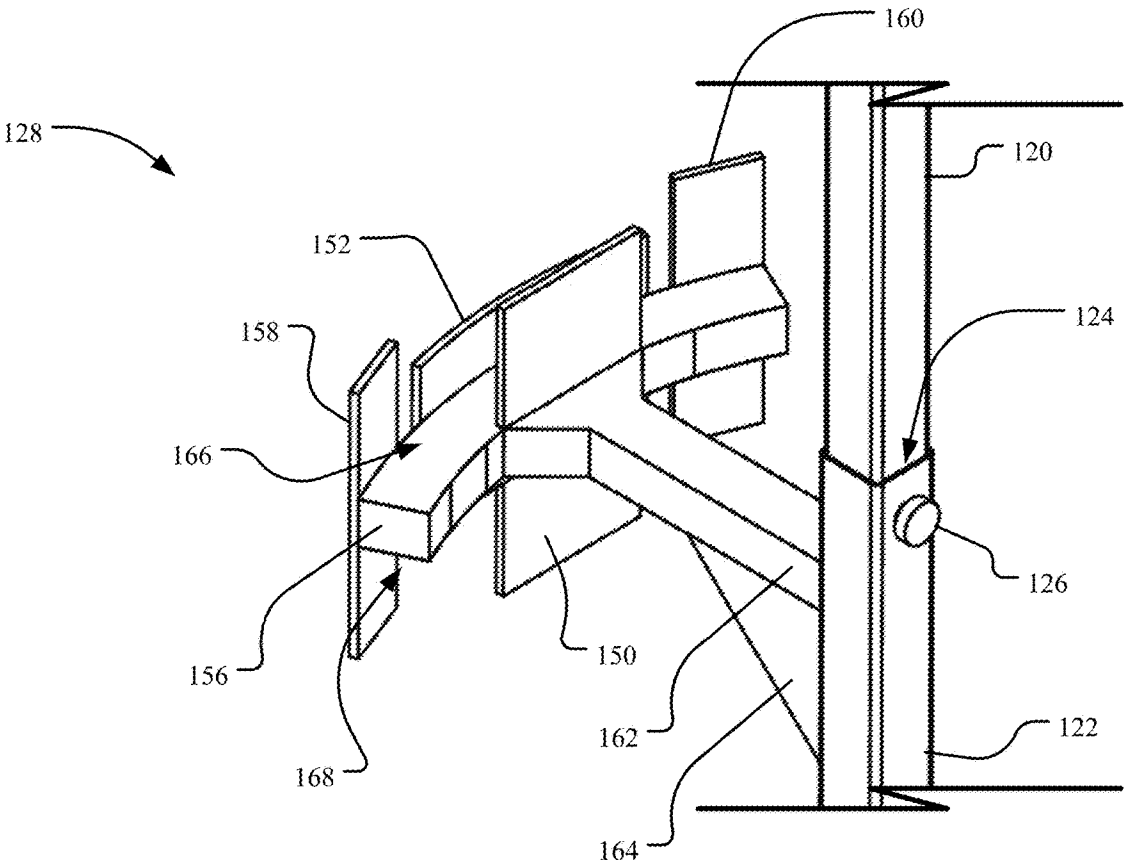
FIG. 4 is a detailed view of an example seat assembly.
Figure 5:
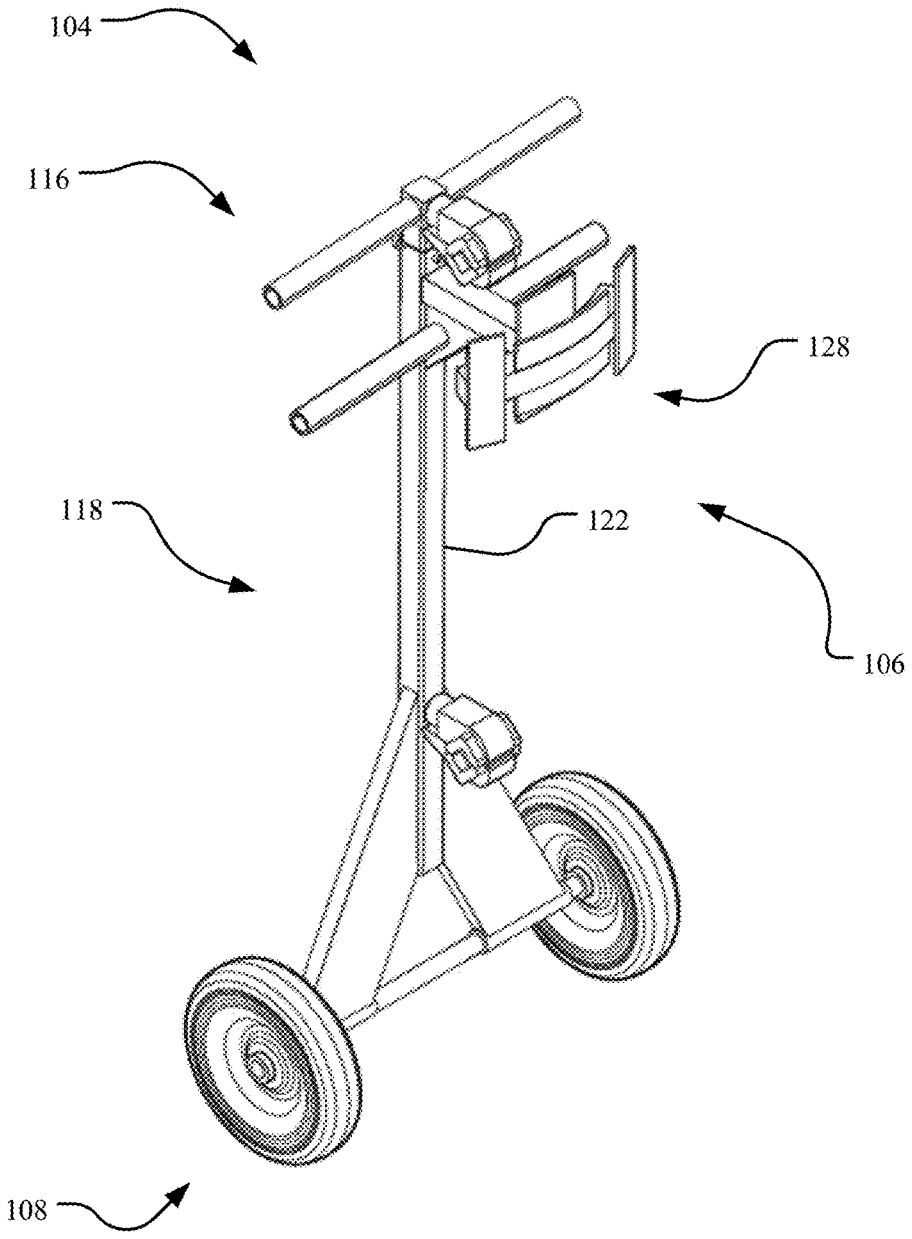
FIG. 5 shows the ballistic dolly in a collapsed configuration.
Figure 6:
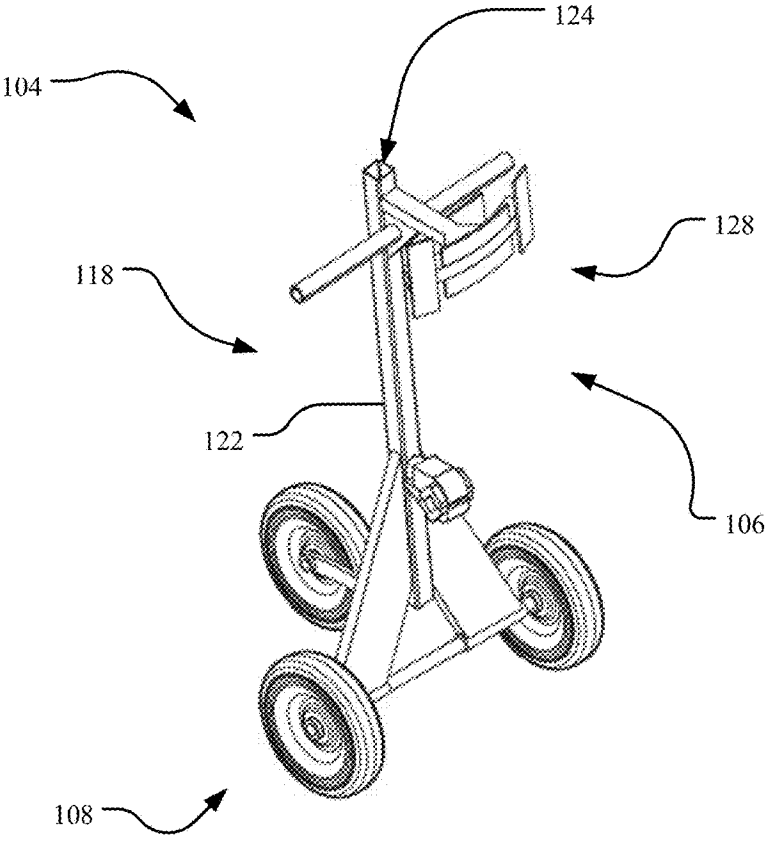
FIG. 6 illustrates the ballistic dolly with a proximal frame assembly removed from a distal frame assembly.
Figure 7:
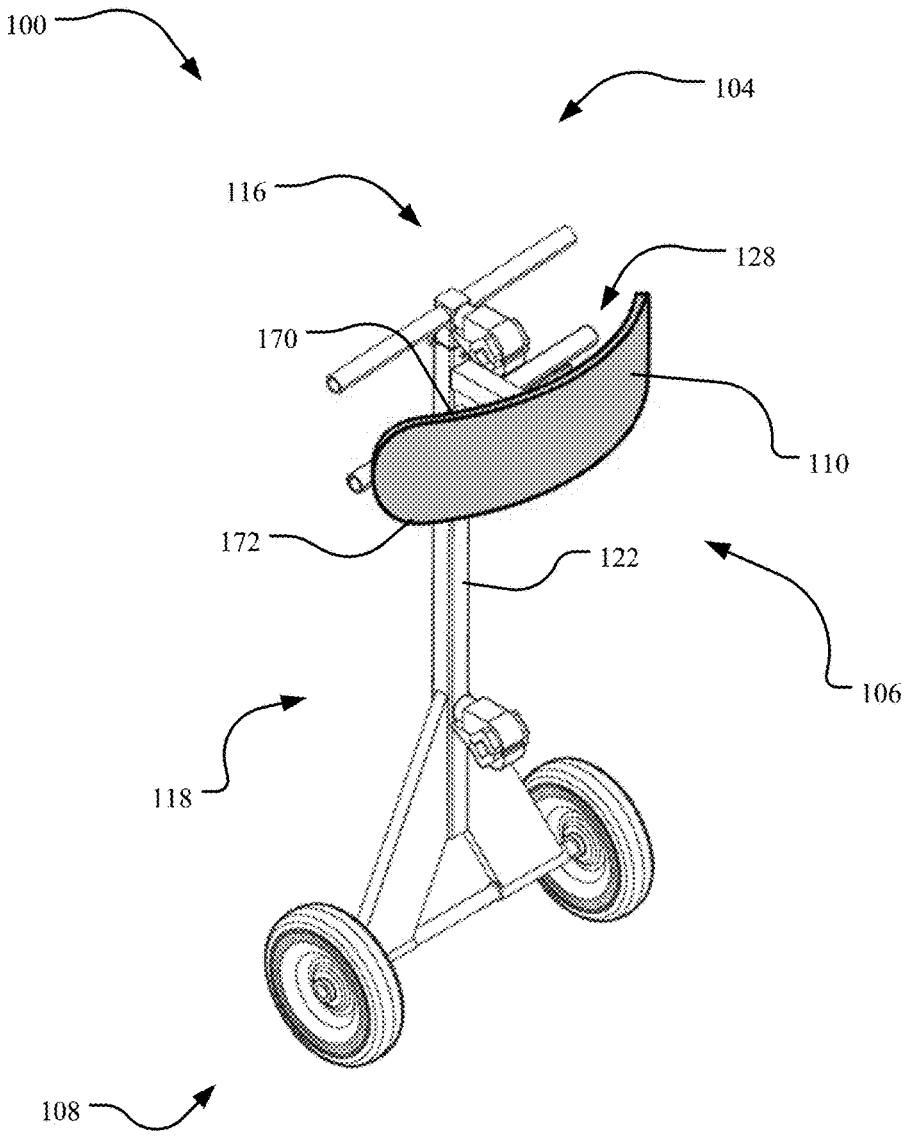
FIG. 7 shows an example overlap panel mounted to the seat assembly of the ballistic dolly.
Figure 8:
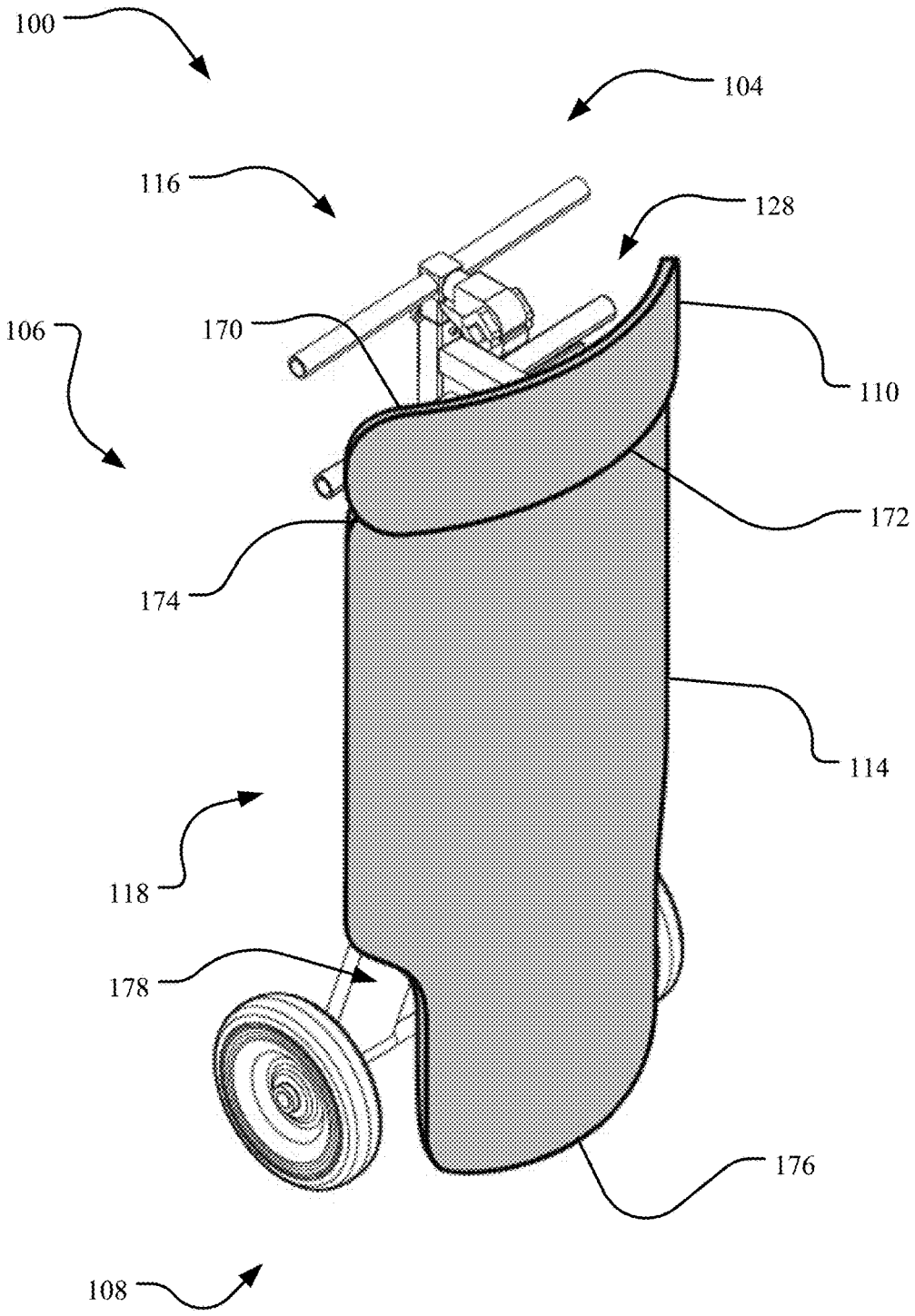
FIG. 8 illustrates the ballistic dolly in a collapsed configuration with an example armor panel releasably mounted to the ballistic dolly in an overlapping relationship with the overlap panel.
Figure 9:
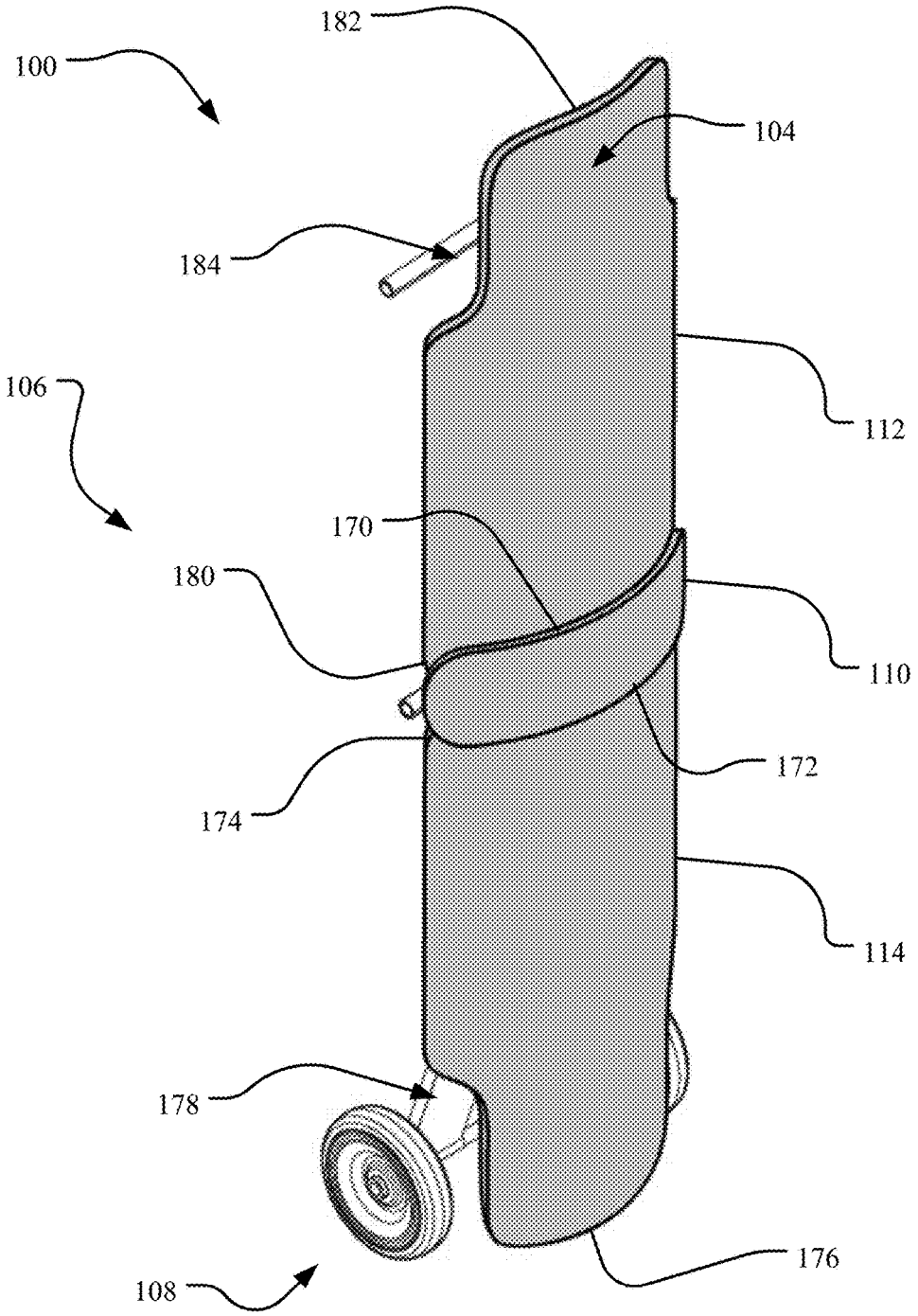
FIGS. 9 and 10 show a front perspective view and a back perspective view, respectively, of the ballistic dolly in an extended configuration with a plurality of armor panels releasably mounted to the ballistic dolly, each in an overlapping relationship with the overlap panel.

Referring to FIGS. 2-6, a detailed description of an example of the ballistic dolly 104 is provided. In one implementation, the frame 106 includes a proximal frame assembly 116 and a distal frame assembly 118. The proximal frame assembly 116 includes a proximal elongated member 120 that is translatable relative to a distal elongated member 122 of the distal frame assembly 118. In one implementation, translation of the proximal elongated member 120 and/or the distal elongated member 122 relative to each other moves the frame 106 between a collapsed configuration and an extended configuration. The translation may further be used to dynamically adjust a height of the frame 106. The height may be adjusted to accommodate a customized ballistic shield. For example, the frame 106 may be moved to the extended configuration to accommodate a full ballistic shield having a plurality of armor panels (e.g., both the first armor panel 112 and the second armor panel 114), and the frame 106 may be moved to the collapsed configuration to provide a half barrier shield having a single armor panel (e.g., the second armor panel 114). In one implementation, the distal elongated member 122 includes a proximal channel 124 in which the proximal elongated member 120 translates. A frame releaser 126, such as a release pin, may be used to releasably fix the proximal elongated member 120 at various positions within the proximal channel 124. As shown in FIGS. 2-3, the proximal elongated member 120 may be translated proximally within the proximal channel 124 to move to the extended configuration or translated distally within the proximal channel 124 to move to the collapsed configuration, as shown in FIG. 5. Further, the proximal frame assembly 116 may be removed, as shown in FIG. 6.

In one implementation, the ballistic dolly 104 includes a seat assembly 128 mounted to or otherwise extending from the frame 106. For example, the seat assembly 128 may be mounted to the distal elongated member 122. The seat assembly 128 includes one or more surfaces adapted to engage an inner surface of the overlap panel 110. The seat assembly 128 further is adapted to releasably receive and orient the first panel 112 and/or the second panel 114 relative to the overlap panel 110.

To releasably secure the first panel 112 and/or the second panel 114 in a dynamically customizable configuration, the ballistic dolly 104 may include one or more attachment assemblies. For example, a first attachment assembly 130 and a second attachment assembly 132 may be positioned on the frame 106 to releasably secure the first panel 112 and the second panel 114, respectively. In one implementation, the attachment assemblies 130-132 are fixed on the proximal frame assembly 116 and the distal frame assembly 118, as shown in FIG. 2. In another implementation, the attachment assemblies 130-132 are removably mounted to the proximal elongated member 120 and/or the distal elongated member 122, as shown in FIG. 3, in a customized position for releasably engaging the armor panels 112 and/or 114. It will be appreciated that the attachment assemblies 130-132 may be permanently fixed to, releasably mounted to, or integrated with the ballistic dolly 104 at various positions and in various manners.

The frame 106 may include one or more handles for steering and maneuvering the ballistic dolly system 100. The handles may be in the form of elongated bars, curved bodies, projections, and/or other griping surfaces. Further, any number of handles may be disposed along the frame 106 at various locations. Further, the handles may be permanently fixed to, releasably mounted to, or integrated with the frame 106, the seat assembly 128, and/or other portions of the ballistic dolly 104. In one implementation, a proximal handle 134 is disposed along the proximal elongated member 120, and a distal handle 136 is positioned along the distal elongated member 122. The distal handle 136 may be included with the seat assembly 128, as shown in FIG. 2 or removed as shown in FIG. 3.

The one or more handles (e.g., the handles 134-136) may be used to control movement of the ballistic dolly system 100 via the transport assembly 108. In one implementation, the transport assembly 108 includes a first leg 138 and a second leg 140 extending from the distal frame assembly 118. More particularly, the first leg 138 and the second leg 140 may extend from the distal elongated member 122 in a distal direction. In one implementation, each of the legs 138-140 includes an opening through which an axel 142 may extend. A first wheel 144 and a second wheel 146 are each rotationally engaged to the axel 142. In one implementation, the axel 142 may be configured such that the first wheel 144 and the second wheel 146 are independently rotatable. For example, the axel 142 may have a first portion corresponding to the first wheel 144 mounted separately from a second portion corresponding to the second wheel 146. In one implementation, the transport assembly 108 is adapted to move the ballistic dolly system 100 with a plurality of degrees of freedom using the wheels 144-146. It will be appreciated, however, that other transport mechanisms in place of or in addition to the wheels 144-146 are contemplated for enabling such movement. As described in more detail herein, a base accessory may be releasably engaged to the transport assembly 108 and/or the distal frame assembly 118. For example, the distal elongated member 122 may include a distal channel 148 for receiving and releasably engaging the base assembly. The distal channel 148 may connect to or be separate from the proximal channel 124.

As can be understood from FIGS. 2-4, in one implementation, the seat assembly 128 includes a back seat panel 150 disposed opposite one or more front seat panels (e.g., a proximal seat panel 152 and a distal seat panel 154). A seat 156 extends between the back seat panel 150 and the one or more front panels 152-154. In one implementation, the seat assembly 128 is mounted to the distal elongated member 122 with a seat bar 162 and a support beam 164.

As described herein, one or more seat channels are formed in the seat assembly 128. In one implementation, a proximal seat channel 166 is formed opposite a distal seat channel 168 by the seat 156, the back seat panel 150, and the one or more front panels 152-154. A first seat mount 158 and a second seat mount 160 may each mounted to or integrated with the seat 156. The seat mounts 158-160 may further contribute to the formation of the seat channels 166-168.

Turning to FIGS. 7-10, in one implementation, the overlap panel 110 includes a body formed from a ballistic material extending between a first edge 170 and a second edge 172. The body of the overlap panel includes an inner surface and an outer surface. In one implementation, the seat assembly 128 includes one or more surfaces adapted to engage the inner surface of the body of the overlap panel 110. The one or more surfaces may include one or more of the front seat panels 152-154, the seat 156, and/or the seat mounts 158-160. In one implementation, the overlap panel 110 is mounted to the seat assembly 128 using the seat mounts 158-160. The overlap panel 110 may be mounted to the seat mounts 158-160 using screws, pins, adhesive, and/or other mounting mechanisms. In one implementation, the mounting mechanisms of the seat mounts 158-160 are disposed on opposite sides of the ballistic void and offset distally and proximally from the seat 156. This arrangement decreases vulnerability of the ballistic dolly system 100 to failure in coverage of the ballistic void.

In one implementation, the second armor panel 114 includes a body formed from a ballistic material extending between a first edge 174 and a second edge 176, and the first armor panel 112 includes a body formed from a ballistic material extending between a first edge 180 and a second edge 182. Each body of the first armor panel 112 and the second armor panel 114 may include one or more cutouts for supporting one or more weapons. For example, the first armor panel 112 may include one or more first cutouts 184, and the second armor panel 114 may include one or more second cutouts 178.

Referring to FIGS. 7-11, the seat assembly 128 is adapted to releasably receive the first armor panel 112 and/or the second armor panel 114 is a selectable orientation. In one implementation, the edge 174 or the edge 176 of the second panel 114 may be inserted into the distal seat channel 168 and releasable engaged to the ballistic dolly 104 using the second attachment assembly 132. Similarly, the edge 180 or the edge 182 of the first panel 112 may be inserted into the proximal seat channel 166 and releasable engaged to the ballistic dolly 104 using the first attachment assembly 130. The seat 156 may include one or more strips of material configured to repel precipitation and/or prevent inadvertent movement of the edges within the respective seat channels 166-168.

Figure 10:
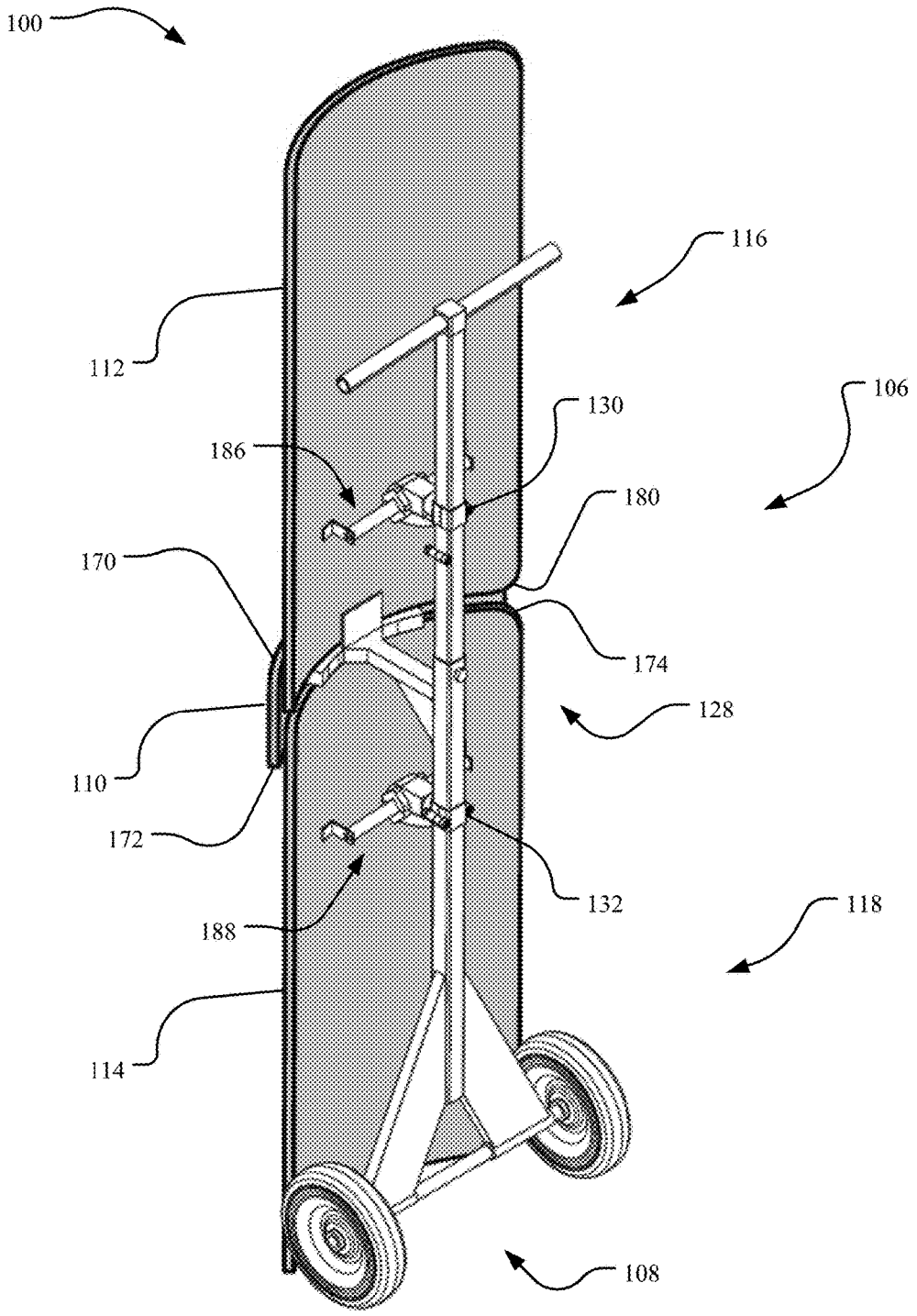

As described herein, the seat channels 166-168 orient the armor panels 112 and 114 in an overlapping relationship with the overlap panel 110. In one implementation, the overlapping relationship includes the selected edge of each of the armor panels 112-114 positioned behind the body of the overlap panel 110, as shown in FIG. 10. Alternatively, the overlapping relationship may include the selected edge of each of the armor panels 112-114 positioned in front of the body of the overlap panel 110. The overlapping relationship may include the selected edge of each of the armor panels 112-114 positioned offset from the respective edge 170 or 172 of the overlap panel 110, as shown in FIG. 10. It will be appreciated that various overlapping relationships where at least a portion of the overlapping panel 110 overlaps with at least a portion of the armor panel 112 and/or 114 are contemplated.

Figure 11:
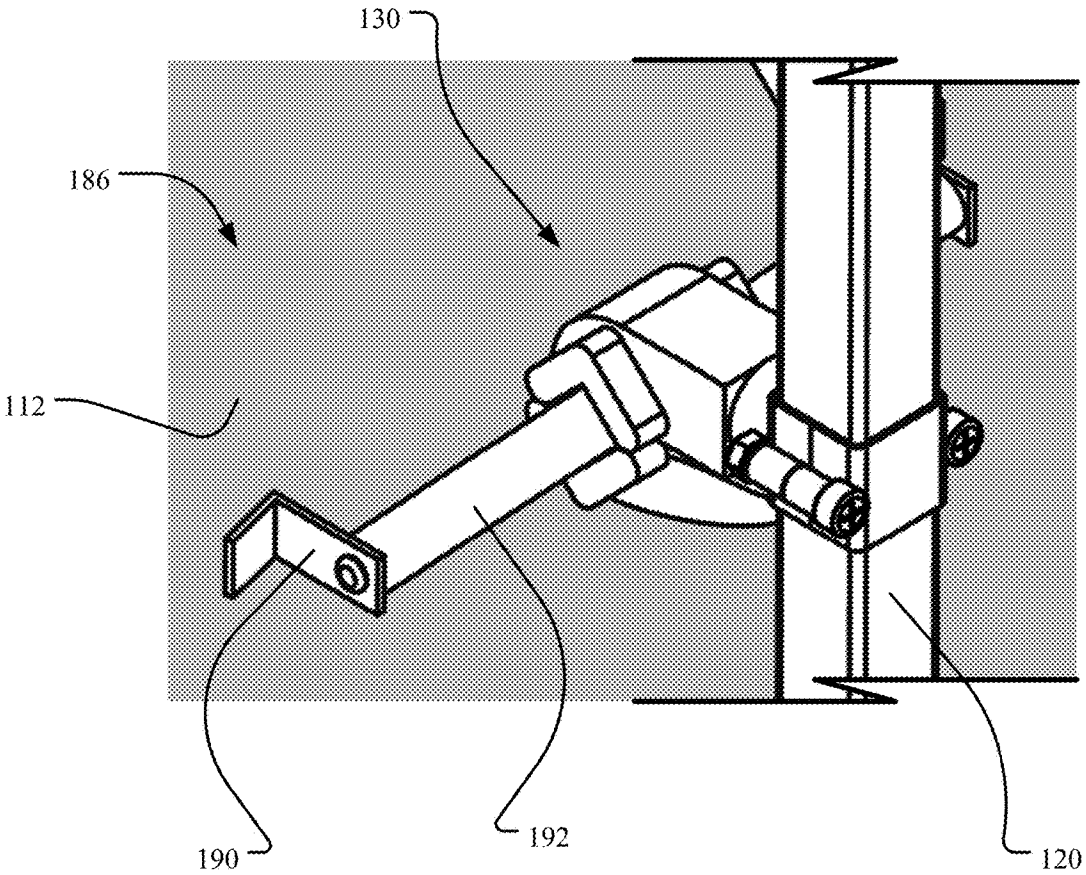
FIG. 11 is a detailed view of an example attachment assembly of the ballistic dolly releasably engaged to a bar of an armor panel.

In one implementation, each of the armor panels 112 and 114 are releasably secured to the frame 106 of the ballistic dolly 104 using one or more attachment assemblies 130-132. The attachment assemblies 130-132 may be adjustable, releasable, fixed, and/or the like. In one implementation, the attachment assemblies 130-132 may be adjusted to be positioned anywhere along the ballistic dolly 104, added, and/or removed. Referring to FIG. 11 and taking the second panel 114 and the second attachment assembly 132 as an example, in one implementation, a bar 192 is mounted to an inner surface of the second armor panel 114 using one or more mounting brackets 190. The attachment assembly 132 is adapted to releasably engage the bar 192.

Figure 12:
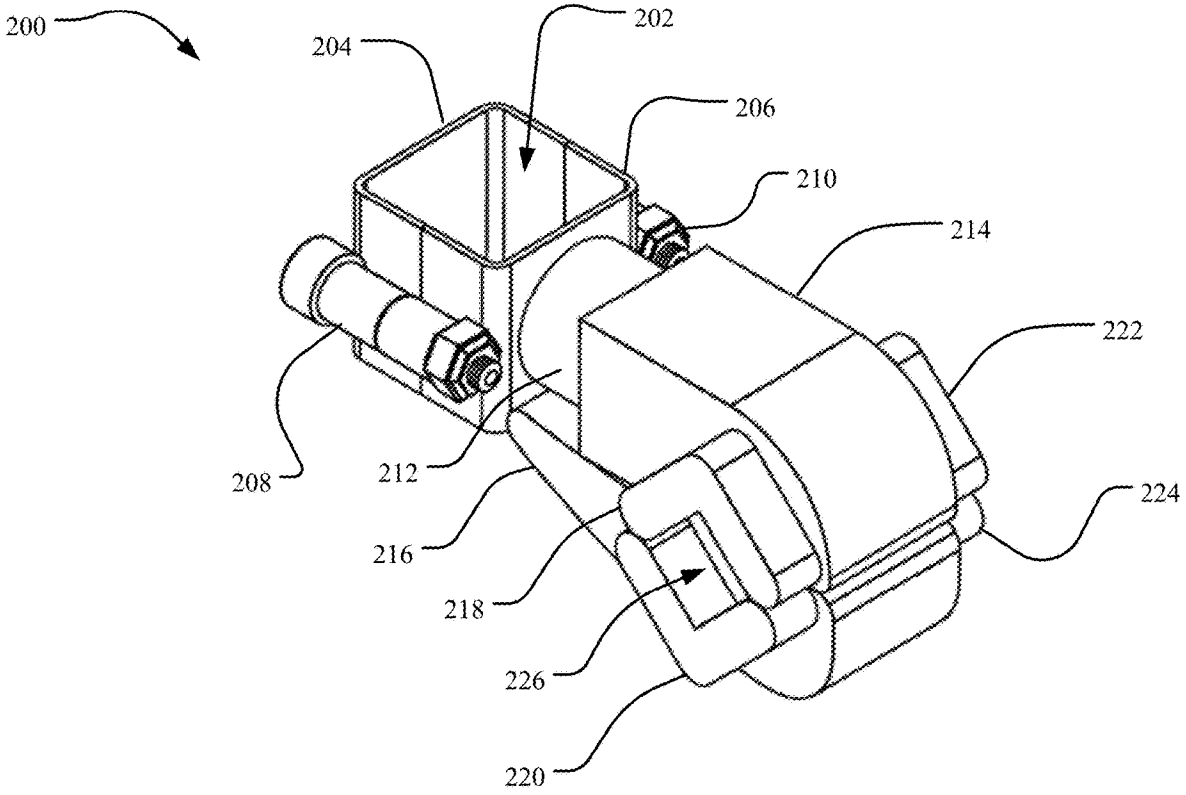
FIG. 12 is a front perspective view of the attachment assembly.
Figure 13:
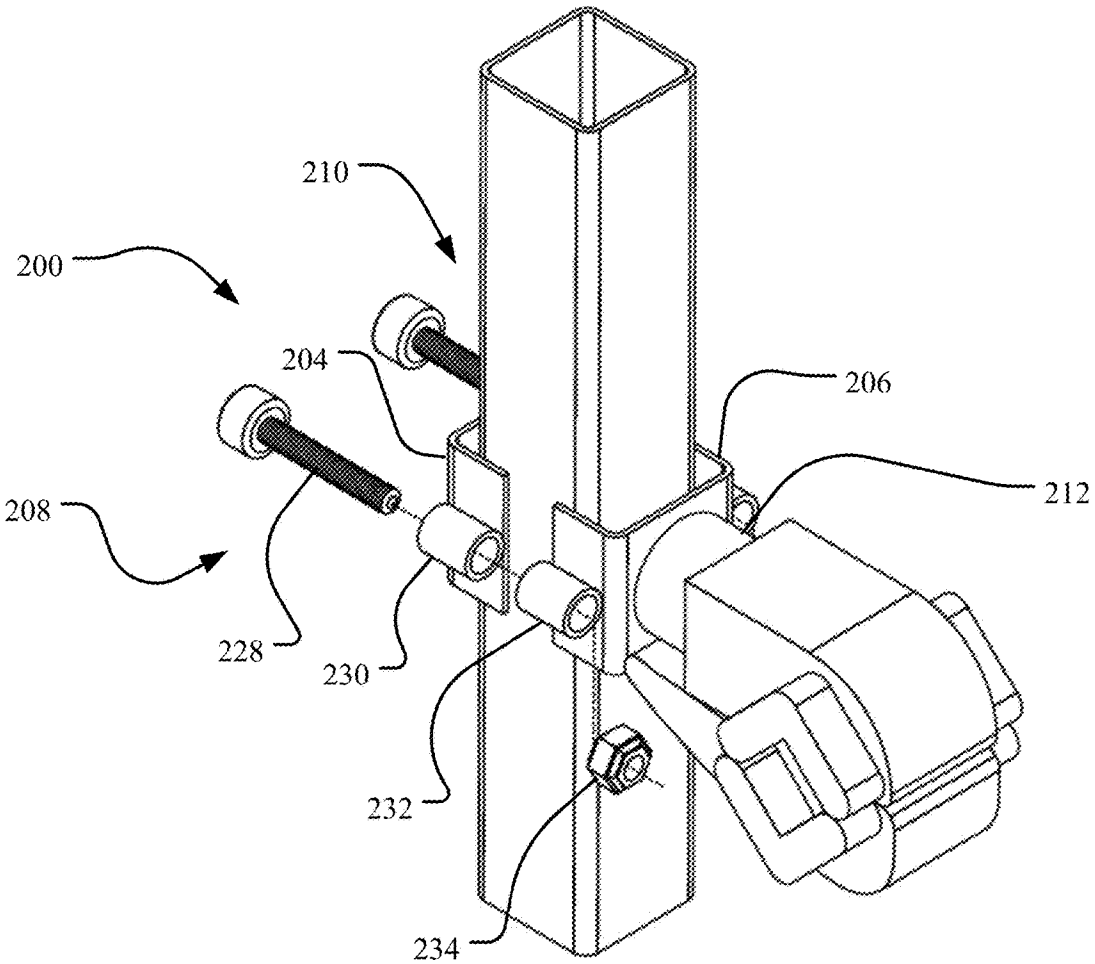
FIG. 13 shows an exploded view of the attachment assembly.
Figure 14:
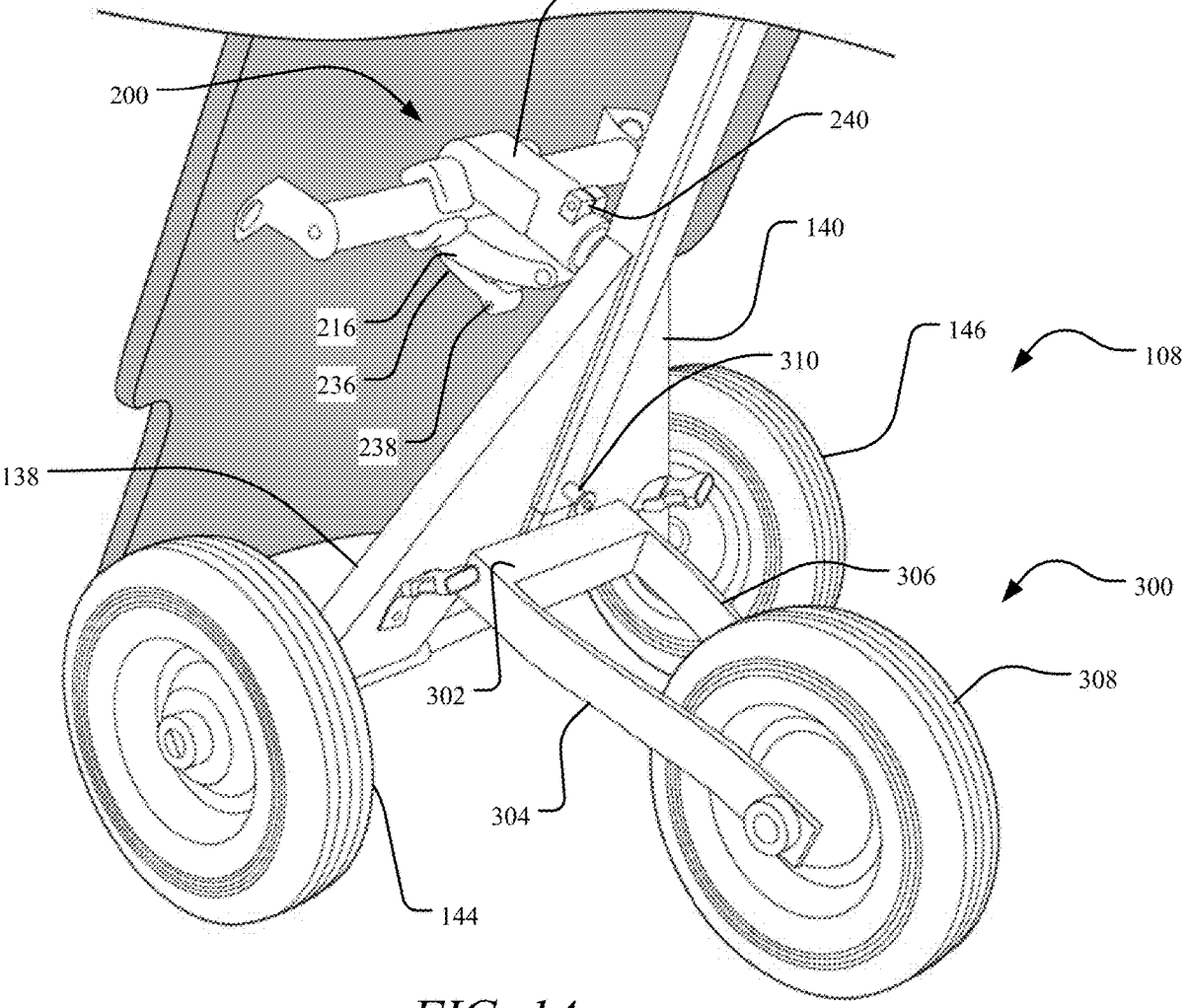
FIG. 14 depicts a back perspective view of an example base accessory releasably engaged to a transport assembly of the ballistic dolly.

For a detailed description of an example attachment assembly 200 that may be applicable to the attachment assemblies 130-132, reference is made to FIGS. 12-14. In one implementation, the attachment assembly 200 includes an attachment channel 202 formed by a body having a first portion 204 and a second portion 206. The portions 204-206 may be an integrated piece or separable from each other. In one implementation, the portions 204-206 are releasably engaged to another using one or more attachments 208-210. The attachments 208-210 may each include a pin 228 insertable through a channel formed by a first receiver 230 of the first portion 204 and a second receiver 232 of the second portion 206 and held in place with a nut 234. It will be appreciated that the attachments 208-210 may be in the form of or include other attachment mechanisms.

In one implementation, the attachment assembly 200 includes a first body 214 mounted to the second portion 206 via a mount 212. A second body 216 is movably mounted, such that the second body 216 moves relative to the first body 214 between an open position and a closed position. An attachment channel 226 is formed between the first body 214 and the second body 216. The attachment channel 226 is adapted to receive and releasably engage the bar 192. In one implementation, the attachment channel 226 is extended on a first side with projections 222-224 and on a second side with projections 218-220.

As shown in FIG. 14, in one implementation, the second body 216 may be locked relative to the first body 214 in the closed position using an arm 236. The arm 236 may be mounted to the first body 214 and/or the second body 216 using a pin 240. The arm 236 is rotatable about an axis 238 to unlock the bodies 214 and 216 and move them to the open position, thereby releasing the bar 192 from the attachment channel 226.

Figure 15:
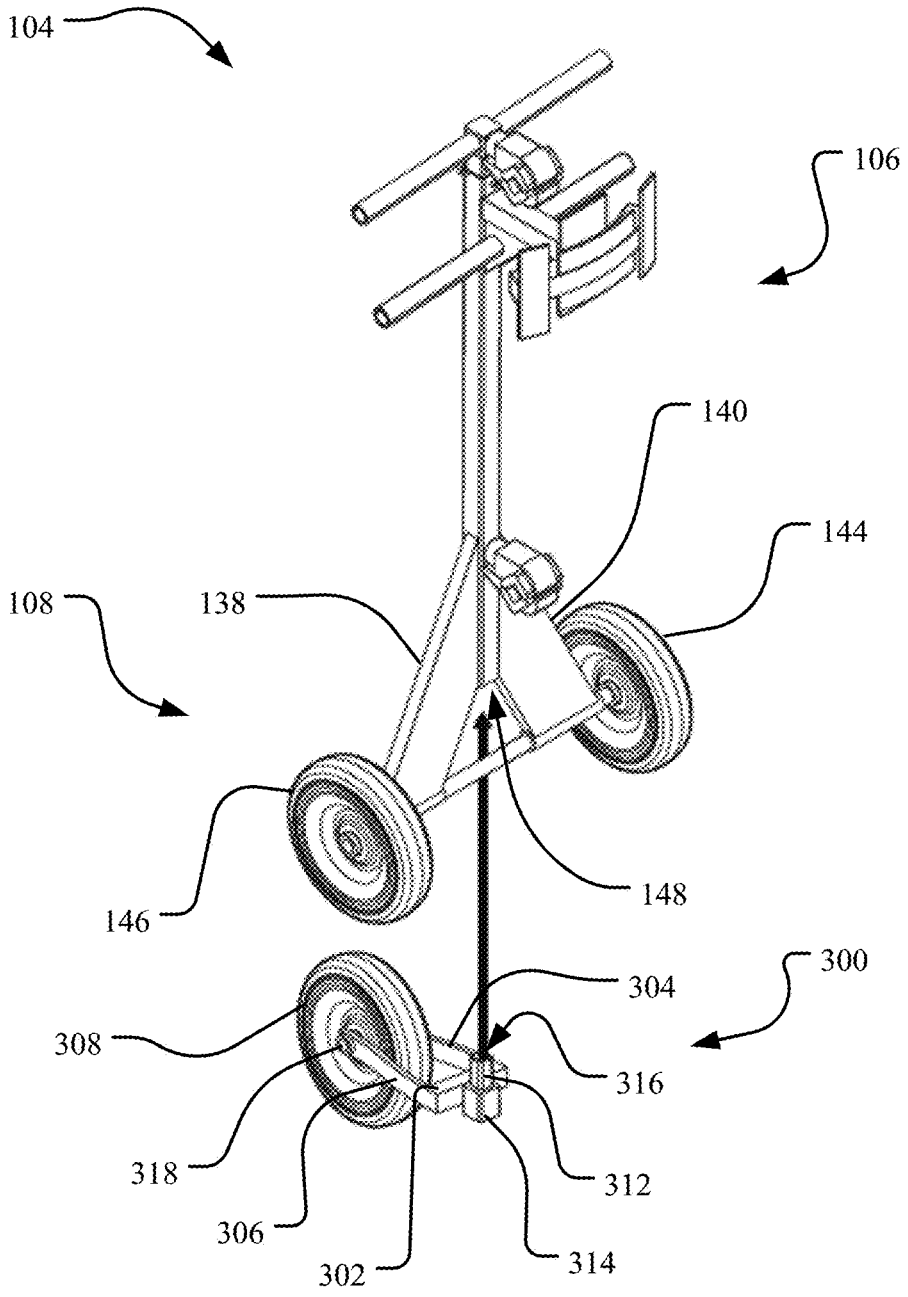
FIG. 15 illustrates the base accessory positioned relative to the transport assembly for engagement.
Figure 16:
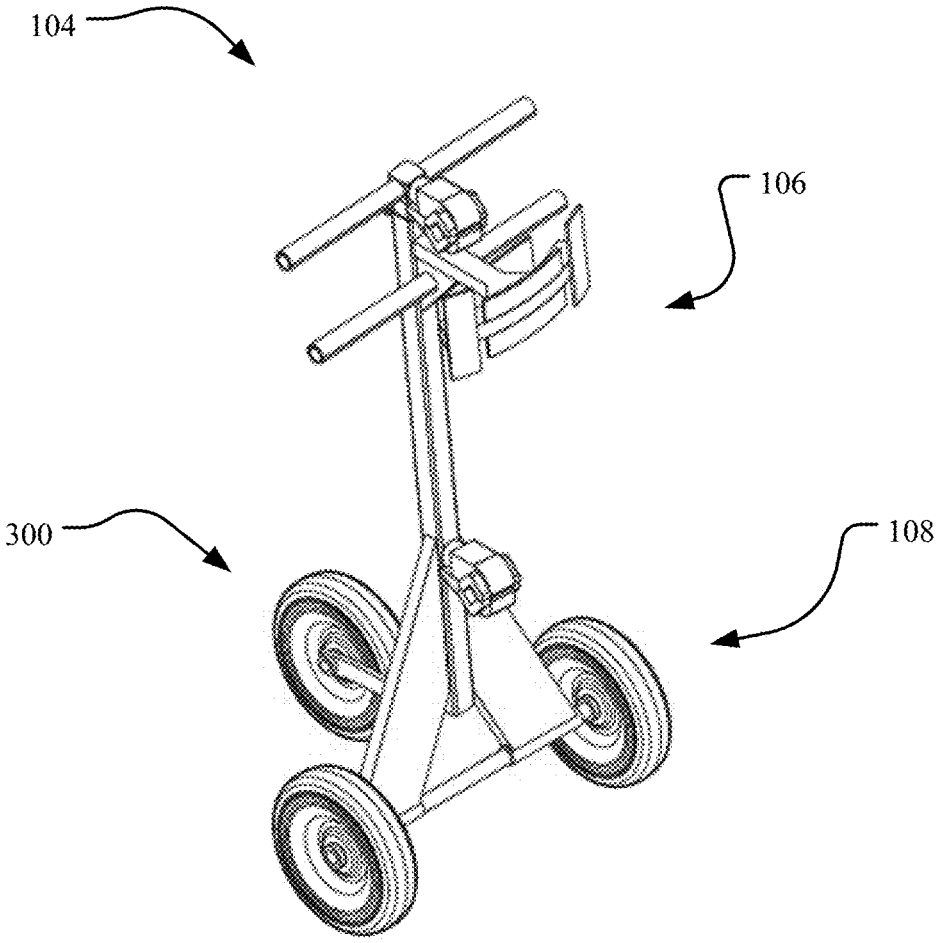
FIG. 16 shows the base accessory engaged to the transport assembly.

Referring to FIGS. 14-16, a base assembly 300 may be releasably engaged to the ballistic dolly 104 at the frame 106 and/or the transport assembly 108. The base assembly 300 may be, without limitation, an additional transport mechanism, a support mechanism (e.g., a support leg), and/or the like. For example, the base assembly 300 may include a first beam 304 connected to a second beam 306 with a base mount 302. The beams 304-306 may releasably engage a wheel 308. More particularly, a pin 318 may releasably secure the wheel 308 to the beams 304-306, such that the wheel 308 is removable by releasing the pin 318, for example, using a wrench. The wheel 308 may be an additional transport point for maneuvering the ballistic dolly system 100. Additionally, if one of the wheels 144-146 is damaged, it may be used as a spare.

The base assembly 300 may include a projection 312 adapted for insertion into the distal channel 148 for releasably engaging the base assembly 300 to the ballistic dolly 104. In one implementation, the base assembly 300 is releasably secured within the distal channel 148 using a release pin 310. The projection 316 may extend from a stopper 314, as shown in FIG. 15.

Figures 17A, 17B:
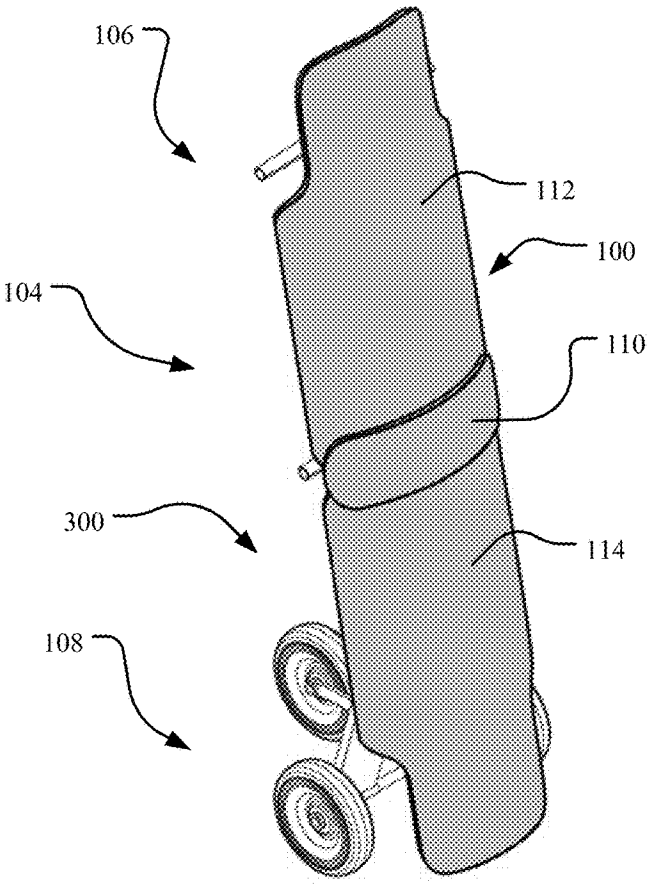
FIG. 17A depicts the ballistic dolly in the collapsed configuration with a single armor panel and the base accessory.
FIG. 17B shows the ballistic dolly in the extended configuration with a plurality of armor panels and the base accessory.
Figure 18:
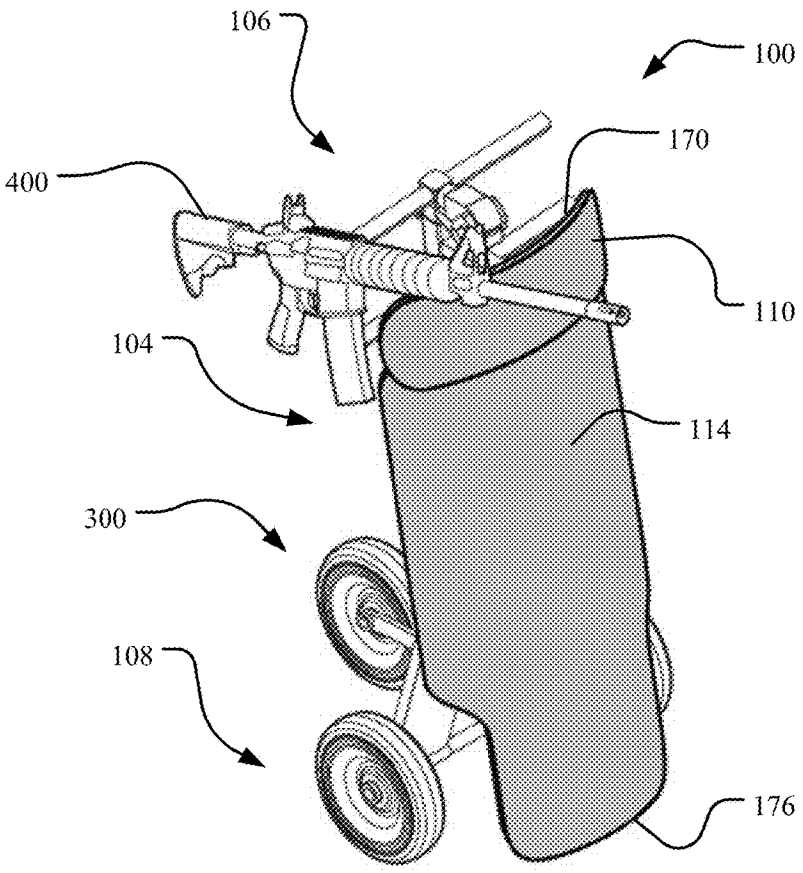
FIG. 18 shows the ballistic dolly in the collapsed configuration with a single armor panel with the ballistic dolly system supporting a weapon.
Figure 19B:
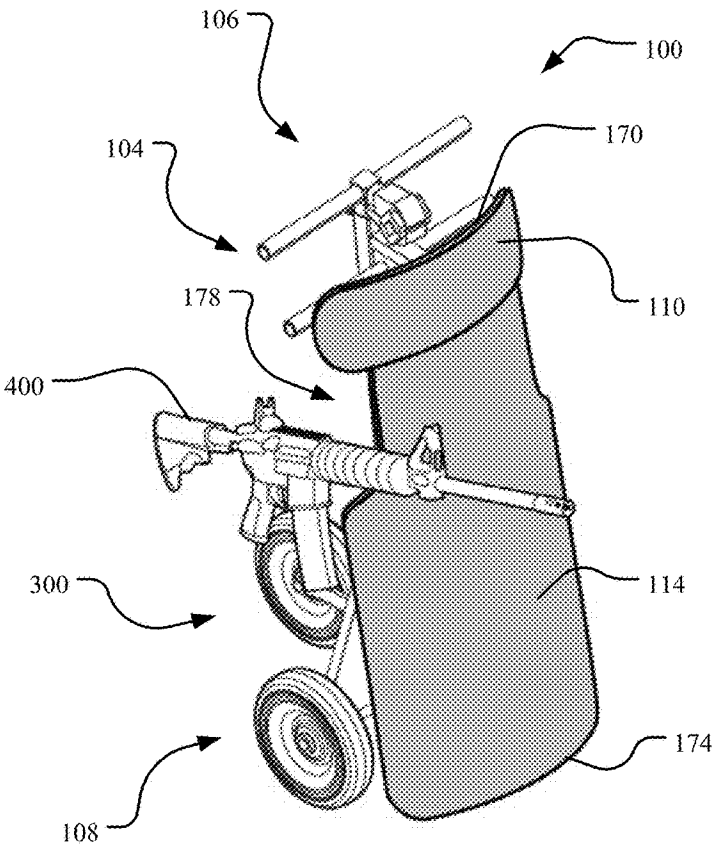
FIGS. 19A and 19B show the ballistic dolly in the collapsed configuration with a single armor panel in an inverted orientation without and with the ballistic dolly system supporting a weapon, respectively.
Figure 19A:
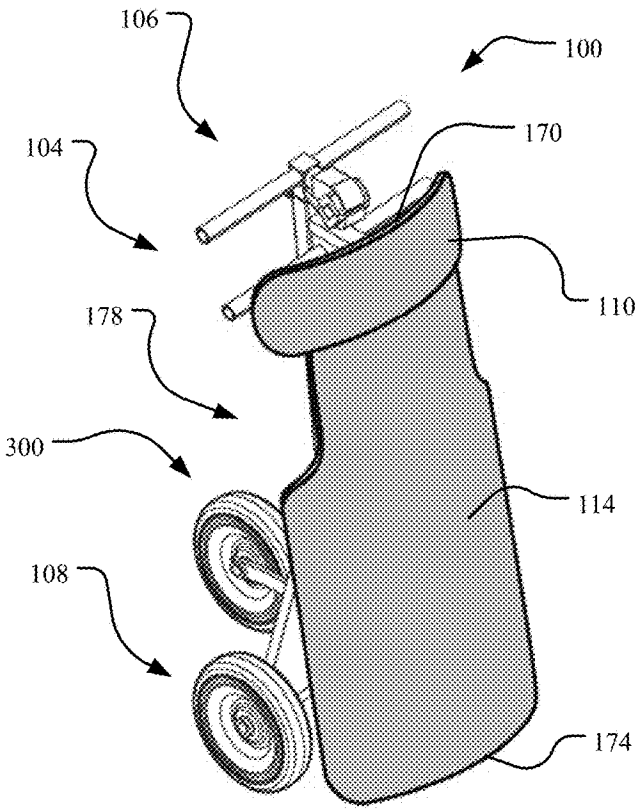

As described herein, the armor panels 112-114 may be releasably received by the ballistic dolly 104 in selected orientations. For example, as shown in FIGS. 17A and 17B, the armor panels 112 and 114 may be used alone or in combination to provide a half barrier shield or a full barrier shield with the ballistic dolly 104 in the collapsed or extended configuration, respectively. Further, one or more edges of the panels 110-114 may be used to support one or more weapons 400, as illustrated in FIG. 18. Alternatively or additionally, the cutouts of the panels 112-114 (e.g., the cutout 178) may be used to support the weapon(s) 400, as shown in FIGS. 19A-19B. The armor panels 112-114 are also invertible as shown in FIGS. 17A-19B to suit the needs of the particular tactical environment. The ballistic dolly system 100 may be oriented upright with the distal edge of the second panel 114 (e.g., the edge 176 or 174 depending on the orientation) positioned on the ground, allowing the individual 102 to operate without holding up the ballistic dolly system 100. During movement, the ballistic dolly system 100 may be tilted to facilitate maneuvering while providing protection.

Figure 20:
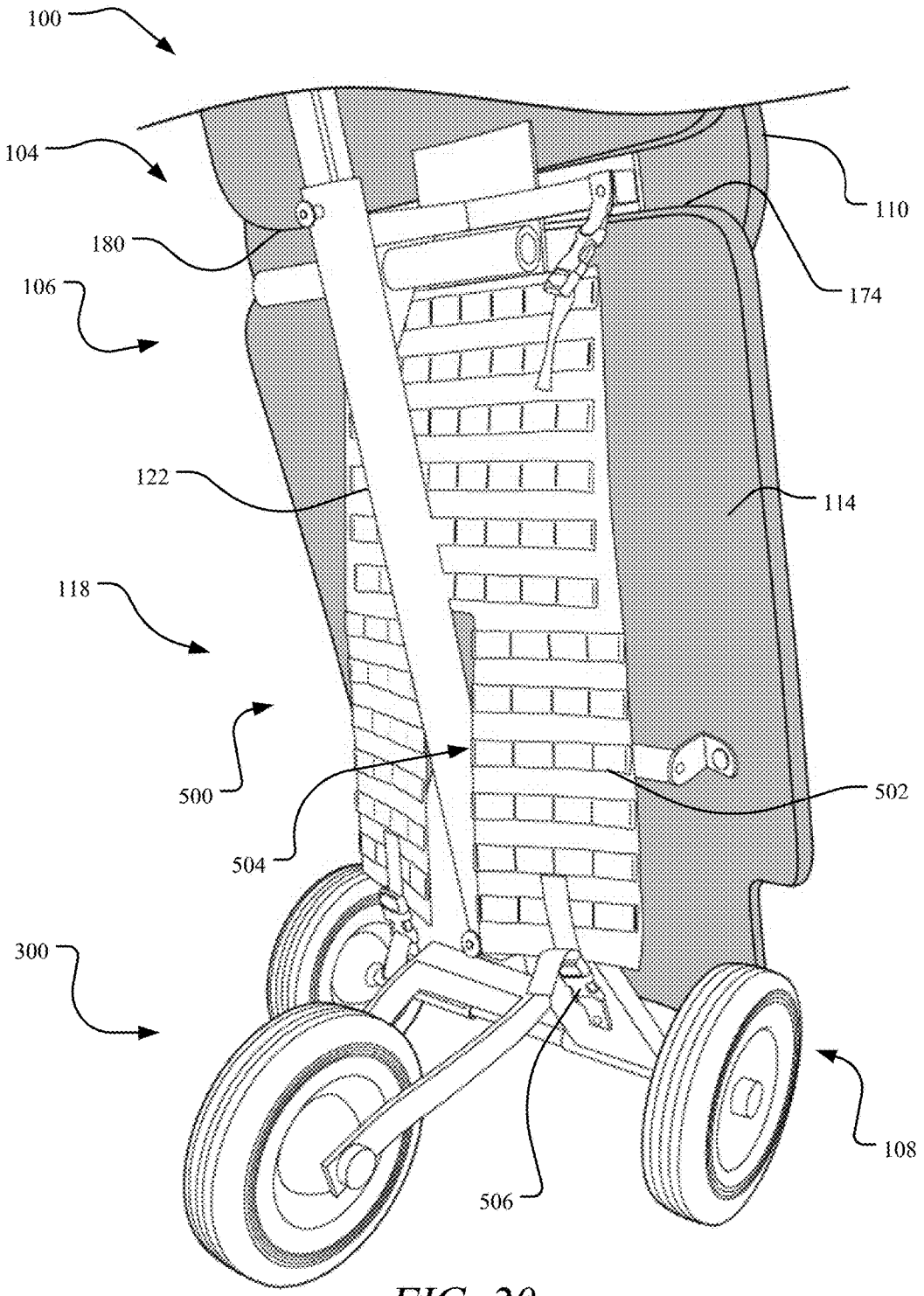
FIG. 20 shows an example accessory panel releasably engaged to the ballistic dolly system.

Referring to FIG. 20, to further customize the ballistic dolly system 100, an accessory panel 500 may be releasably engaged to the ballistic dolly system 100, for example, at the ballistic dolly 104 and/or one of the panels 110-114. The accessory panel 500 may be releasably engaged using one or more buckles 506, for example. The accessory panel 500 may be releasably engaged to the ballistic dolly system 100 for storing and transporting mission critical equipment, including, without limitation, ammunition, weapons, communication devices, power sources, pouches, medical supplies, nourishment, and/or the like. For example, the accessory panel 500 may include one or more rows of webbing on a body 502 for releasably securing and carrying various types of mission critical equipment. In one implementation, the body 502 includes a slit 504 adapted to accommodate the distal elongated member 122.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular examples. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A ballistic dolly system comprising:

a frame assembly of a ballistic dolly having an elongated member;

a seat assembly mounted to the elongated member, the seat assembly having one or more surfaces adapted to engage an inner surface of a body of an overlap panel; and one or more seat channels formed in the seat assembly, each of the one or more seat channels adapted to releasably engage an edge of a body of an armor panel, each of the one or more seat channels orienting the edge of the body of the armor panel in an overlapping relationship with the body of the overlap panel such that a portion of the body of the armor panel overlaps with a portion of the body of the overlap panel, the overlapping relationship covering a ballistic void of the ballistic dolly.

2. The ballistic dolly system of claim 1, wherein the overlapping relationship includes the edge of the body of the armor panel positioned behind the body of the overlap panel.

3. The ballistic dolly system of claim 1, wherein the overlapping relationship includes the edge of the body of the armor panel offset from an edge of the body of the overlap panel.

4. The ballistic dolly system of claim 1, wherein the one or more seat channels includes a proximal seat channel disposed opposite a distal seat channel.

5. The ballistic dolly system of claim 4, wherein the proximal seat channel is adapted to releasably receive a first edge of a body of a proximal armor panel and the distal seat channel is adapted to releasable receive a first edge of a body of distal armor panel.

6. The ballistic dolly system of claim 1, wherein each of the one or more seat channels are adapted to receive the edge of the body of the armor panel with the body of the armor panel positioned in a selectable orientation.

7. The ballistic dolly system of claim 1, wherein the elongated member includes a channel adapted to releasably receive a proximal elongated member of a proximal frame assembly, the proximal elongated member translatable within the channel of the elongated member, thereby adjusting an overall height of the ballistic dolly.

8. The ballistic dolly system of claim 1, further comprising:

a transport assembly mounted to the frame assembly, the transport assembly adapted to move the ballistic dolly with a plurality of degrees of freedom.

9. The ballistic dolly system of claim 8, wherein the transport assembly includes a first wheel adapted to move independently from a second wheel.

10. The ballistic dolly system of claim 1, wherein the elongated member includes a channel adapted to releasably receive a projector of a base accessory.

11. The ballistic dolly system of claim 10, wherein the base accessory includes an additional wheel.

12. The ballistic dolly system of claim 11, wherein the additional wheel includes a brake.

13. The ballistic dolly system of claim 10, wherein the base accessory includes a support leg.

14. The ballistic dolly system of claim 1, further comprising:

at least one handle disposed along the ballistic dolly.

15. The ballistic dolly system of claim 1, further comprising:

at least one attachment assembly disposed along the frame assembly, the at least one attachment assembly having an attachment channel adapted to releasably engage a bar mounted on an inner surface of the body of the armor panel.

16. The ballistic dolly system of claim 15, wherein the at least one attachment assembly is adjustable.

17. The ballistic dolly system of claim 1, further comprising:

one or more attachment points adapted to releasably engage at least one accessory panel.

18. The ballistic dolly system of claim 17, wherein the at least one accessory panel includes one or more of a molle webbing panel, a medical panel, or a pouch.

19. A ballistic dolly system comprising:

an armor panel having a body formed from a ballistic material extending between a first edge and a second edge, the body having an inner surface and an outer surface, the first edge and the second edge being selectably receivable into a seat channel formed in a seat assembly of a ballistic dolly, the seat channel orienting the body of the armor panel in an overlapping relationship with the body of an overlap panel such that a portion of the body of the armor panel overlaps with a portion of the body of the overlap panel, the overlapping relationship covering a ballistic void of ballistic dolly; and a bar mounted to the inner surface of the body of the armor panel, the bar adapted to releasably engage an attachment assembly disposed along a frame assembly of the ballistic dolly.

20. The ballistic dolly system of claim 19, wherein the body of the armor panel includes one or more cutouts.

21. A ballistic dolly system comprising:

a frame assembly of a ballistic dolly having an elongated member;

a seat assembly mounted to the elongated member, the seat assembly having one or more surfaces adapted to engage an inner surface of a body of an overlap panel;

one or more seat channels formed in the seat assembly, each of the one or more seat channels adapted to releasably engage an edge of a body of an armor panel, each of the one or more seat channels orienting the edge of the body of the armor panel in an overlapping relationship with the body of the overlap panel; and a transport assembly mounted to the frame assembly, the transport assembly adapted to move the ballistic dolly with a plurality of degrees of freedom.

* * * * *